US006137068A

United States Patent [19]

Padulo

[11] Patent Number: 6,137,068

[45] Date of Patent: Oct. 24, 2000

[54] COMBINED HANDLE-GUARD AND GRIP FOR PLUG-IN CIRCUIT BREAKERS

[75] Inventor: Michael N. Padulo, Kirkland, Canada

[73] Assignee: Astec International Limited, The Hong Kong Special Administrative Region of the People's Republic of China

[21] Appl. No.: 09/324,067

[22] Filed: Jun. 1, 1999

[51] Int. Cl.[7] ..... H01H 9/02

[52] U.S. Cl. ..... 200/43.16; 200/50.02; 200/333

[58] Field of Search ..... 200/17 R, 43.01, 200/43.11, 43.14, 43.15, 43.16, 43.19, 43.21, 50.01, 50.02, 50.11, 400, 401, 500, 501, 318, 327–333, 334

[56] References Cited

U.S. PATENT DOCUMENTS

| | | | |
|---|---|---|---|
| 3,863,042 | 1/1975 | Nicol | 200/153 T |
| 4,151,386 | 4/1979 | Nicol et al. | 200/303 |
| 4,358,810 | 11/1982 | Wafer et al. | 361/93 |
| 4,761,521 | 8/1988 | Beck et al. | 200/50 |
| 4,978,816 | 12/1990 | Castonguay et al. | 200/43.14 |
| 5,060,107 | 10/1991 | Castonguay | 361/115 |
| 5,120,921 | 6/1992 | DiMarco et al. | 200/401 |
| 5,148,910 | 9/1992 | Williams | 200/43.19 |
| 5,495,082 | 2/1996 | Zaffetti et al. | 200/400 |
| 5,500,495 | 3/1996 | Benda et al. | 200/43.14 |
| 5,717,178 | 2/1998 | Turner et al. | 200/50.01 |
| 5,719,363 | 2/1998 | Händler | 200/50.02 |
| 5,796,060 | 8/1998 | Füchsle et al. | 218/79 |
| 5,853,305 | 12/1998 | Bedrossian | 439/787 |
| 5,907,140 | 5/1999 | Smith | 200/43.19 |

*Primary Examiner*—Michael Friedhofer
*Attorney, Agent, or Firm*—Coudert Brothers

[57] ABSTRACT

A combined handle-guard and grip protects the actuator-handle of a circuit breaker from being inadvertently displaced during normal circuit breaker operation while also positioning a user's fingers to automatically trip the circuit breaker into a non-conducting state whenever the user grasps the grip surfaces of the handle-guard to remove or install the circuit breaker. In a preferred embodiment, the shield surfaces form a slot dimensioned to permit the unrestricted movement of the circuit breaker handle. A first grip surface is disposed at one of the slot. A second grip surface is disposed at the other end of the slot. A passageway in the second grip surface is shaped and positioned so that a distal portion of the circuit breaker actuator-handle extends through the passageway when the circuit breaker is in an on-position. When the user grasps the second grip surface, pressure is applied to the actuator-handle, tripping the circuit breaker into a non-conducting state whenever the circuit breaker is inserted or removed.

18 Claims, 8 Drawing Sheets

COMBINED HANDLE-GUARD AND GRIP FOR PLUG-IN CIRCUIT BREAKERS

FIELD OF THE INVENTION

The present invention relates generally to handle-guards to protect the actuator-handle of a circuit breaker from accidentally being tripped. More particularly, the present invention is directed towards a handle-guard and grip structure for a plug-in circuit breaker, wherein the grip structure ensures that the actuator-handle is not in an on-state when the circuit breaker is being installed or removed.

BACKGROUND OF THE INVENTION

Circuit breakers are important components of many electronic systems, such as power supplies. Circuit breakers commonly comprise a movable electrical contact and a stationary contact. The movable electrical contact is typically coupled to an electromagnetic device that opens the breaker contacts when an over-current condition is detected. During normal circuit operation an actuator mechanism couples the stationary and movable breaker contacts so that the circuit breaker is in a conducting, or on-state. However, when an over-current condition is detected, the circuit breaker trips and the actuator mechanism separates the breaker contacts so that the circuit breaker enters a non-conducting, or off-state.

FIG. 1 is a perspective view of an exemplary prior art circuit breaker 11. As is seen, when the prior art circuit breaker 11 is designed to be plugged in or removed, it will typically have a grip 1 to facilitate the user grabbing circuit breaker 11. The principles of circuit breaker operation are well known. Breaker contacts 8, 9 open in response to an over-current condition. The mechanism that opens breaker contacts 8, 9 is commonly known as an actuator.

An additional linkage mechanism (not shown in FIG. 1) couples the interior actuator mechanism (not shown in FIG. 1) to an actuator-handle 16. Actuator-handle 16 is also known in the prior art as a "handle" although sometimes the terms "actuator" or "actuator switch" are also used to describe actuator-handle 16. In the present application handle 16 is described as an "actuator-handle" to avoid potential confusion with the interior actuator mechanism and with grip 1.

The actuator-handle 16 provides several functions. First, the position of the actuator-handle 16 provides a visual indication of the operating state of the circuit breaker. Typically the actuator-handle 16 is mechanically coupled so that it rotates and/or translates relative to the surface of the circuit breaker to indicate the operating state of the circuit breaker. Additionally, the actuator-handle 16 is mechanically coupled to the actuator so that the user is able to manually set/reset the circuit breaker to an on-state or an off-state depending on the position of the actuator-handle. The actuator-handle 16 is useful, for example, to reset a circuit breaker after it has been tripped by an over-current condition. Additionally, the actuator-handle 16 is often used to intentionally cause the circuit breaker to be non-conducting, e.g., when maintenance or repair of the electronic system is planned. The actuator-handle 16 of a circuit breaker is commonly configured so that a slight pressure applied to the actuator-handle in its on-position results in the circuit breaker actuator-handle moving to a position where the current breaker is non-conducting.

A problem with the actuator-handle 16 of a conventional circuit breaker 11 is that its position may be inadvertently changed, resulting in the circuit breaker, and thus the electronic systems to which the circuit breaker is attached, being turned on or off at an inappropriate time. This is highly undesirable since it may result in damage to the electronic systems or may cause injury to users. Consequently, it is desirable in many applications to use a safety mechanism to prevent the inadvertent displacement of the handle.

FIG. 2A is an exploded perspective view of a prior art circuit breaker 11 with an actuator-handle 16 disposed in a slot 32 with two slot ends 32A, 32B corresponding to on/off states of the circuit breaker. A handle-guard 31, in the shape of a C-shaped spring clip 33 having S-shaped ends 34, 35 is designed to fit in slot 32. When the handle-guard 31 is in place, it protects actuator-handle 16 from being inadvertently displaced while still providing sufficient clearance for actuator-handle 16 to translate from its on-position to its off-position when an over-current condition is detected. Handle-guard 31 may be removed from slot 32 to enable the actuator-handle 16 to be manually repositioned.

FIG. 2B shows a partial side view of circuit breaker 11 with handle-guard 33 in place. The motion of the actuator-handle 16 to a tripped state is indicated in phantom. As can be seen in FIG. 2B, there is sufficient clearance that actuator-handle 16 is free to move underneath the bottom surface 31A of handle-guard 31. End surfaces 34, 35 of handle-guard 31 fit into end regions of slot 32, but are not rigidly connected to slot 32.

While the prior art handle-guard of FIG. 2A provides a safety benefit, it has several drawbacks. One drawback is that handle-guard 31 substantially blocks access to actuator-handle 16. Consequently, the user needs to remove handle-guard 31 every time they want to change the position of actuator-handle 16. Another drawback is that handle-guard 31 blocks a front (head-on) view of the position of actuator-handle 16. This may make it hard to determine the position of actuator-handle 16 where there is poor background lighting or in electronic systems where circuit breaker 11 is located close to a wall or other obstacle so that the user cannot obtain a side view of actuator-handle 16.

Conventional handle-guards 31 protect the actuator-handle 16 but do not provide a grip or grip surface. Commonly, a separate grip 1 is provided if the user is intended to grasp circuit breaker 11, e.g., when the circuit breaker is being installed in a breaker panel. Another problem with prior art circuit breakers is that there is no mechanism for ensuring that the circuit breaker is in a non-conducting state when the circuit breaker is installed or removed. It is comparatively easy for users to mistakenly install or remove a circuit breaker with the actuator-handle 16 in an on-position. This is a problem for all types of circuit breakers. However, it is likely to be a more severe problem for circuit breakers that are designed to be rapidly installed/removed, such as plug-in circuit breakers. Compact plug-in circuit breakers typically have male plug connections that are inserted or removed from female sockets in a base connector. This has the advantage that old circuit breakers may be quickly removed and new circuit breakers quickly installed. However, if the circuit breaker is removed/installed with the actuator-handle in an on-position, unwanted and undesirable electrical conduction may occur. For example, with the actuator-handle inadvertently positioned in an on-position, sparking may occur between the male plugs and female sockets when the male plugs are disposed a short distance from the female sockets during insertion or removal. Additionally, undesirable currents may flow if the circuit breaker is installed/removed with the actuator-handle inadvertently left in the on-position. For example, inserting a plug-in circuit breaker into its base may result in the premature flow of current in an electrical system if the actuator-handle is accidently positioned in the on-position. This may result in a current that causes damage to the electrical system and/or causes an electrical shock to the user.

Mechanical interlock means are one solution to the problem of inserting/removing plug-in circuit breakers. FIG. 3 shows a side view of a prior art circuit breaker with a mechanical apparatus to automatically turn-off (i.e., open the electrical contacts) of a circuit breaker whenever it is installed or removed. Plug-in circuit breaker 200 may have grips to facilitate a user grabbing circuit breaker 200. As shown in FIG. 3, a plug-in circuit breaker 200 has plugs 210 dimensioned to fit into sockets 220 of a base connector 280. A plunger 230 coupled by a spring 240 is dimensioned to fit into a plunger socket 225 which adjusts the position of a linkage mechanism 250, 260 so that actuator-handle 270 automatically is switched into an off-position whenever circuit breaker 200 is removed from base connector 280. The mechanical plunger apparatus shown in FIG. 3 provides an important safety benefit. However, it requires a comparatively complicated linkage mechanism. This increases the cost, complexity, and size of circuit breaker 200 compared to conventional plug-in circuit breakers lacking the desired safety interlock feature. Moreover, plunger 230 must be designed to have a long operating lifetime, i.e., not deteriorate during normal use. However, a spring plunger mechanism can degrade over time due to a variety of physical mechanisms, such as a change in spring characteristics of the spring, corrosion of moving parts, and dust/debris entering sockets and/or moving parts.

The previously described drawbacks of conventional handle-guards and mechanical interlocks are of particularly concern in the context of miniature plug-in circuit breakers used in distribution modules, such as those used in telecommunications applications. A conventional handle-guard, such as that shown in FIG. 2A may make it awkward to visually determine the state of the circuit breaker, particularly during removal/installation. A conventional safety plunger mechanism, such as that shown in FIG. 3, substantially increases the cost and complexity of a miniature plug-in circuit breaker. Moreover, combining the handle-guard of FIG. 2A with the safety plunger of FIG. 3 results in a circuit breaker that had the drawbacks of both safety devices.

What is desired is an improved safety device for plug-in circuit breakers that provides the benefits of protecting the actuator-handle from being inadvertently displaced during normal use while also ensuring that the actuator-handle is automatically switched to an off-state during insertion/removal of the circuit breaker.

SUMMARY OF THE INVENTION

The present invention is directed towards a combined handle-guard and grip that prevents the actuator-handle of a circuit breaker from being inadvertently tripped during normal operation while also automatically tripping the actuator-handle, when it is in an on-position, into a non-conducting position when the circuit breaker is removed or installed.

The present invention generally comprises: a shield shaped to surround the actuator-handle to protect the actuator-handle of the circuit breaker from being inadvertently tripped while permitting the free movement of the actuator-handle, the shield having an opening to allow manual displacement of the actuator-handle and to enable the present position of the actuator-handle to be viewed; a first grip portion forming a portion of said shield; a second grip portion forming another portion of said shield; and a passageway formed in said shield shaped and dimensioned so that a distal portion of the actuator-handle extends through the passageway adjacent the exterior surface of the first grip portion when the actuator-handle is in an on-position.

In a preferred embodiment, the shield is shaped to form a slot and first and second grip portions are disposed at opposite ends of the slot with the passageway extending through the first grip portion. An indicator surface is preferably disposed on an interior surface of the second grip portion to facilitate a user visually verifying that the circuit breaker actuator-handle is in an off-position. The first grip portion preferably forms an overhang that protects the distal portion of the actuator-handle in its on-position.

One object of the present invention is a handle-guard that protects the actuator-handle of a circuit breaker from being inadvertently tripped.

Another object of the present invention is a handle-guard in which the user automatically trips the circuit breaker actuator-handle into a non-conducting position whenever the user grasps the grip portions of the handle-guard.

Still another object of the present invention is a handle-guard that facilitates the quick resetting of a tripped circuit breaker. The opening in the shield of the present invention permits a user to view the present position of the actuator-handle and to manually reset a tripped circuit breaker.

Still yet another object of the present invention is a thermally insulating grip that facilitates a user removing a hot circuit breaker.

These and other objects of the present invention will become apparent to those skilled in the art from the following detailed description and from the detailed drawings.

DETAILED DESCRIPTION OF THE INVENTION

The present invention generally comprises a combined handle-guard and grip apparatus for circuit breakers which: 1) protects the actuator-handle of the circuit breaker from being inadvertently displaced; 2) provides grip surfaces to facilitate a user removing or installing the circuit breaker; and 3) provides the additional safety benefit of automatically positioning the circuit breaker actuator-handle into a non-conducting state whenever the user grasps the grip surfaces to remove or install the circuit breaker.

Figure 1:
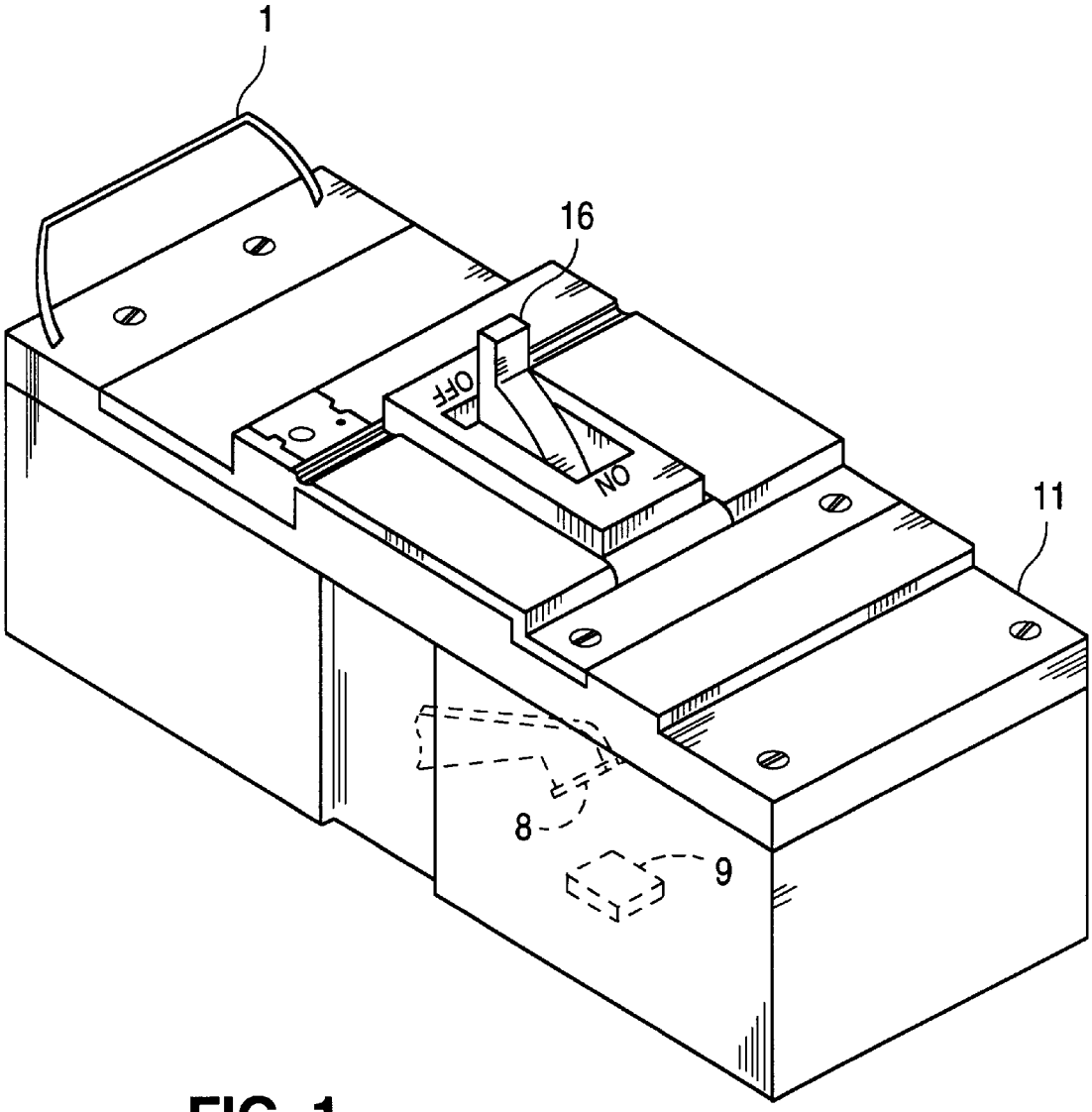
FIG. 1 (PRIOR ART)
FIG. 1 is a perspective view of a prior art circuit breaker.
Figure 2A:
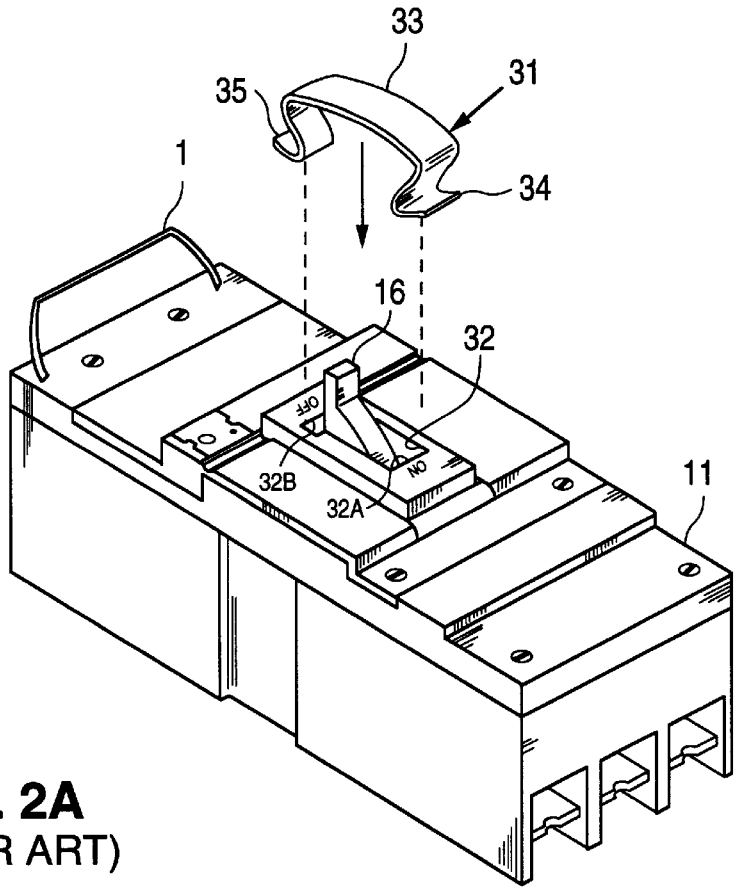
FIG. 2A (PRIOR ART)
FIG. 2A is a perspective view of a prior art handle-guard for a circuit breaker.
Figure 2B:
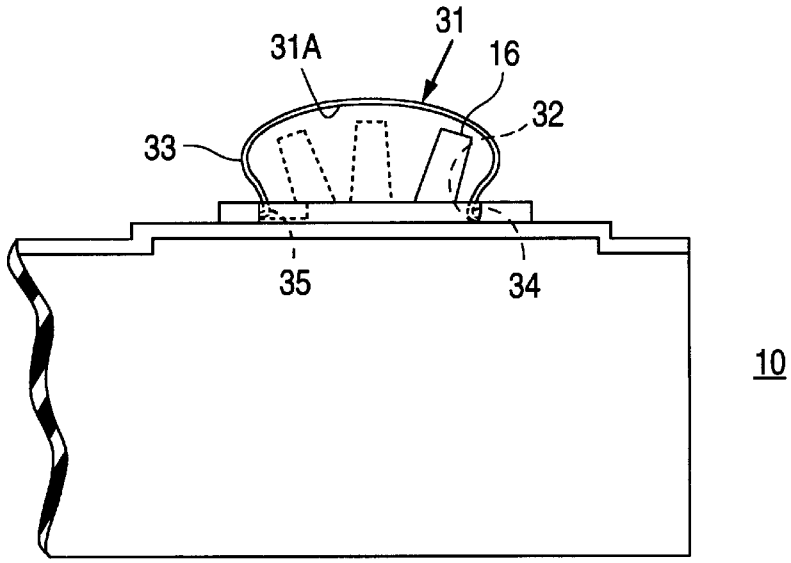
FIG. 2B (PRIOR ART)
FIG. 2B is a partial side view of the prior art handle-guard of FIG. 2A.
Figure 3:
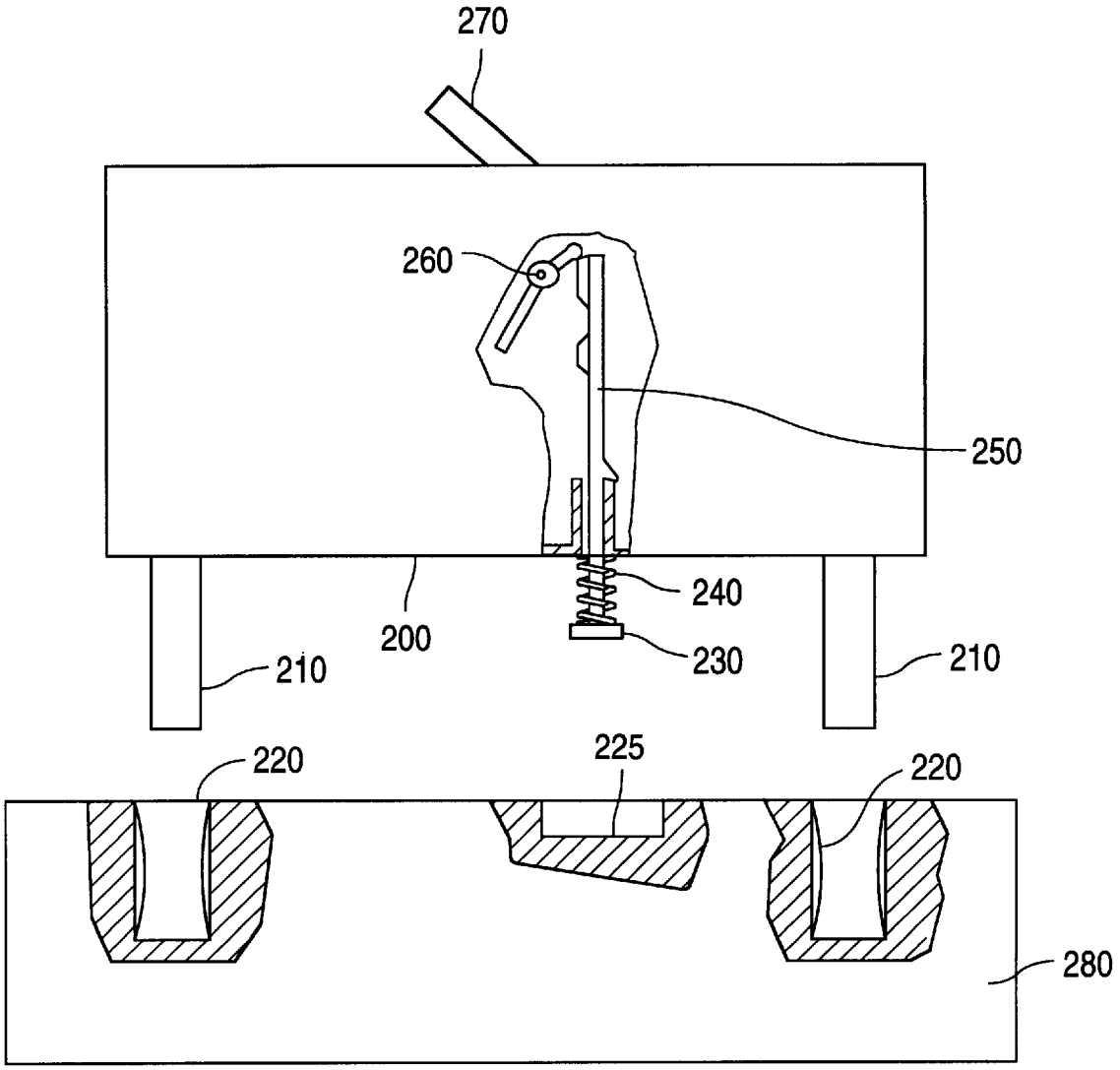
FIG. 3 (PRIOR ART)
FIG. 3 is a side view of a prior art spring-plunger mechanism to automatically switch a plug-in circuit breaker into an off-position whenever the circuit breaker is removed from its socket.
Figure 4:
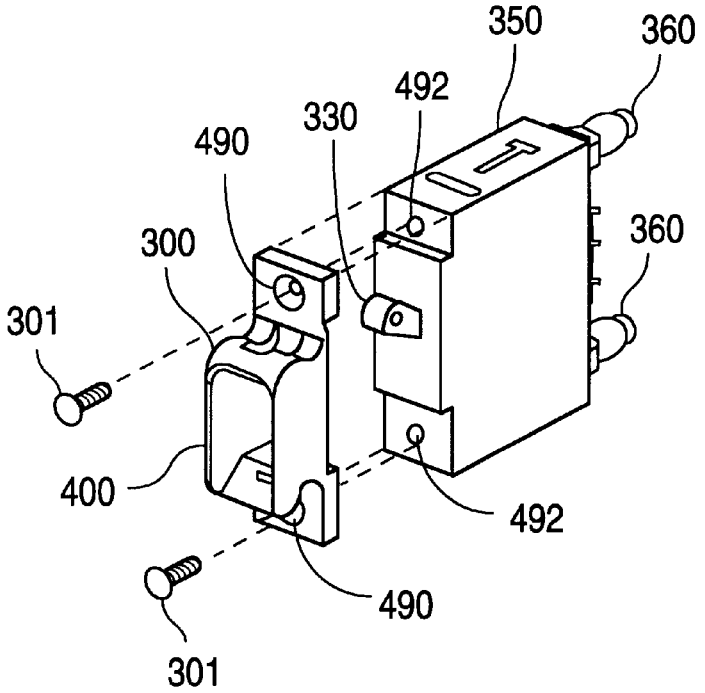
FIG. 4 is an exploded perspective view showing a preferred embodiment of the handle-guard of the present invention mounted on a plug-in circuit breaker.

FIG. 4 is an exploded perspective view of a preferred embodiment of the handle-guard 400 of the present invention fitted onto the surface of a conventional plug-in circuit breaker 350. As shown in FIG. 4, circuit breaker 350 has male plugs 360 dimensioned to fit into conventional base-socket (not shown in FIG. 3). Circuit breaker 350 has a conventional actuator-handle 330 on its front face that moves from an on-position to a non-conducting position when an over-current is sensed by circuit breaker 350. Most commonly, this corresponds to actuator-handle 330 having two positions: an on-position and an off-position. However, actuator-handle 330 may also have three positions: an on-position, a tripped-position, and an off-position.

Handle-guard 400 may be sold as an individual unit that is mounted onto a separately manufactured circuit breaker 350 by screws 301. Screw holes 490 and threaded holes 492 in circuit breaker 350 enable screws 301 to fasten handle-guard 400 onto a circuit breaker 350 as shown in FIG. 4, although other conventional ways known in the art to fasten handle-guard 400 onto the front face of circuit breaker 350 may be used, e.g., using glue, clips, etc. Additionally, handle-guard 400 may also be manufactured as an integral part of circuit breaker 350.

Figure 5:
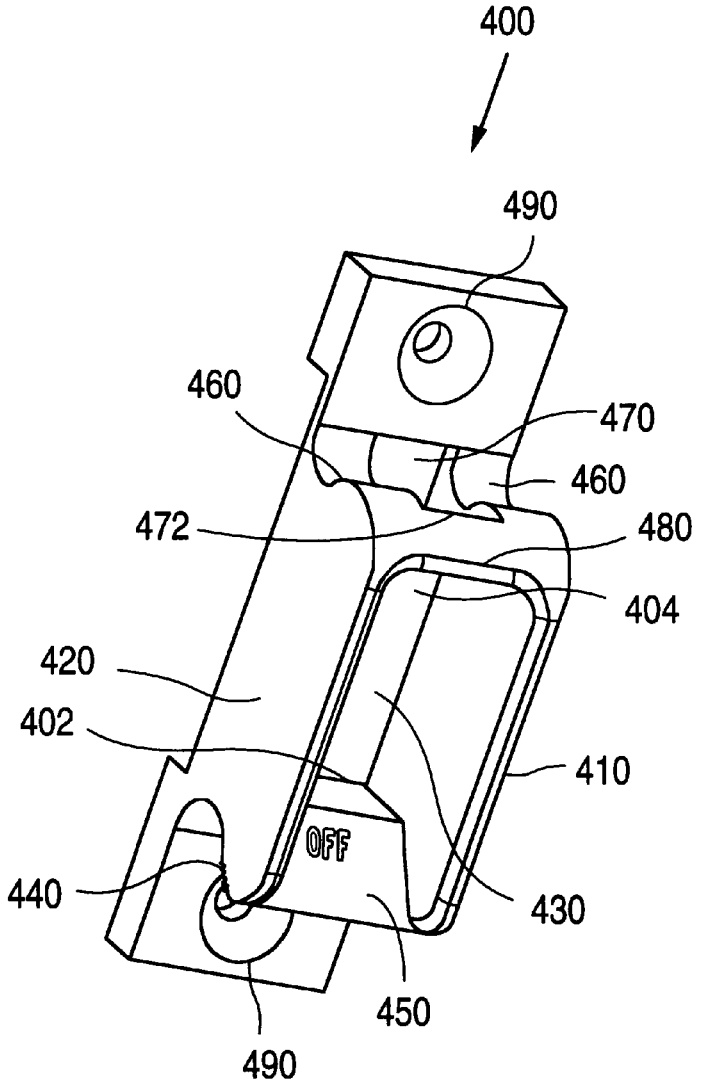
FIG. 5 is a detailed perspective view of the handle-guard of the present invention.

FIG. 5 shows a detailed perspective view of handle-guard 400. Handle-guard 400 is preferably manufactured from a material that is a good electrical and thermal insulator. The actuator-handle 330 is shielded by a handle shield comprised of two side-shields 410, 420 and two distal grip portion ends 440, 460 which are spaced apart from each other to form a slot 430 dimensioned to accommodate the movement of actuator-handle 330 (not shown in FIG. 4) between different operational states of a circuit breaker 350 (not shown in FIG. 4). A first grip portion 460 is disposed at one end 404 of slot 430. A passageway 470 in first grip portion 460 connects to slot 430. A transverse shield surface 480 preferably connects side shields 410, 420 and forms one upper surface 472 of passageway 470. A second grip portion 440 is disposed at another end 402 of slot 430. An indicator surface 450 is preferably disposed on an inner surface of second grip portion 440. As shown in FIG. 4, indicator surface 450 is preferably a surface labeled with writing, letters, or symbols to indicate when the actuator-handle of the circuit breaker is in an off-position.

Figure 6:
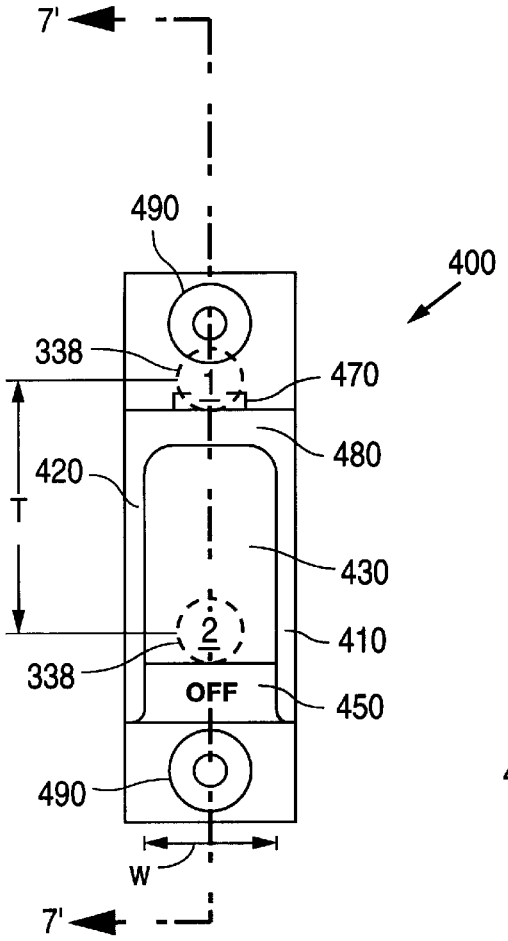
FIG. 6 is a front view of the handle-guard of the present invention.

FIG. 6 is a front view of handle-guard 400. A distal portion 338 of actuator-handle 330 is shown in phantom in an on-position 1 and in an off-position 2. It can be seen that in its off-state, the distal portion 338 of actuator-handle 330 is disposed adjacent indicator surface 450. However, in its on-position 1 distal portion 338 of actuator-handle 330 extends out slightly from passageway 470 adjacent the exterior surface of first grip portion 460. As indicated in phantom, actuator-handle 330 moves between positions 1,2 by a transverse distance T. It can also be seen in FIG. 6 that the width, W, of slot 430 is wider than that of actuator-handle 330.

Figure 7:
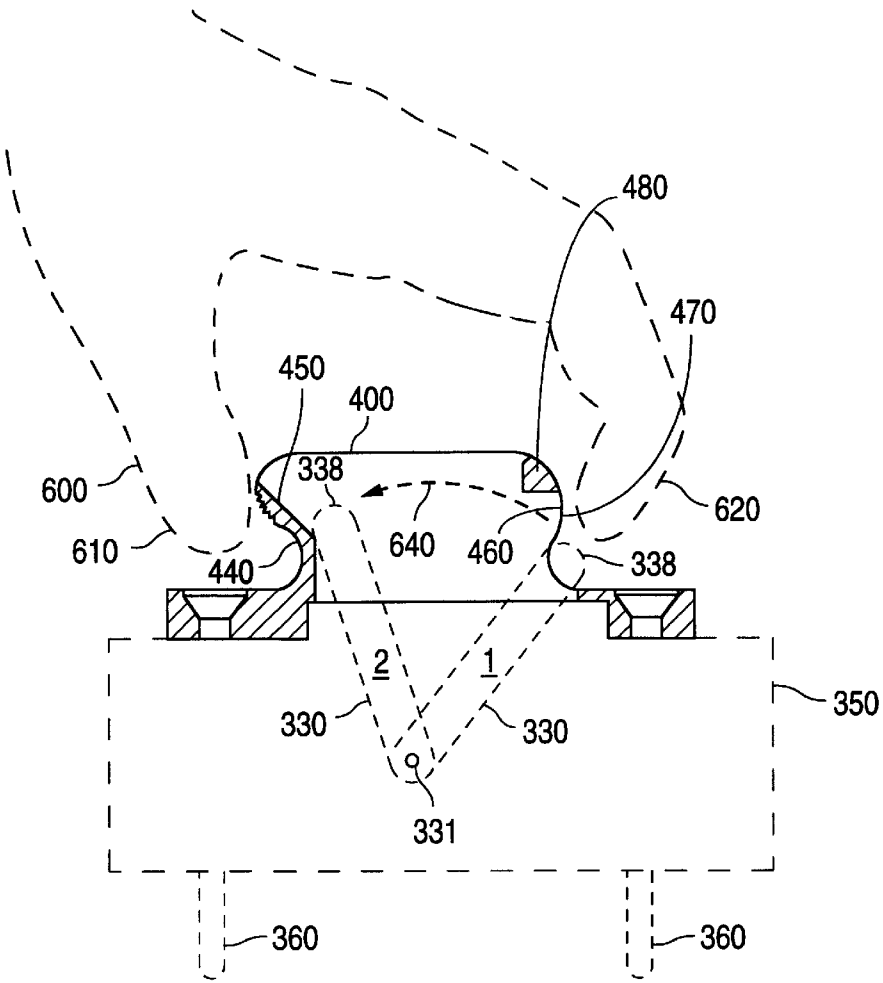
FIG. 7 is a cross-sectional view of the handle-guard of the present invention along line 7—7 of FIG. 6 showing the motion of the actuator-handle between an on-position and an off-position.
Figure 11A:
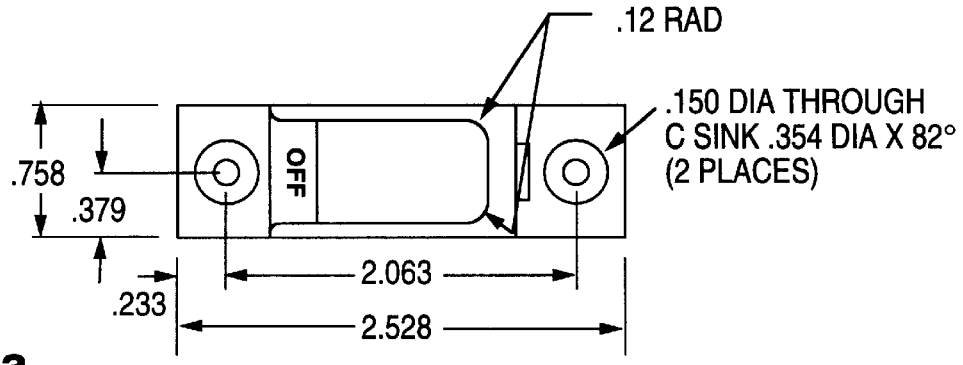
FIG. 11 shows preferred dimensions of the handle-guard of the present invention for common plug-in circuit breakers.
Figure 11B:
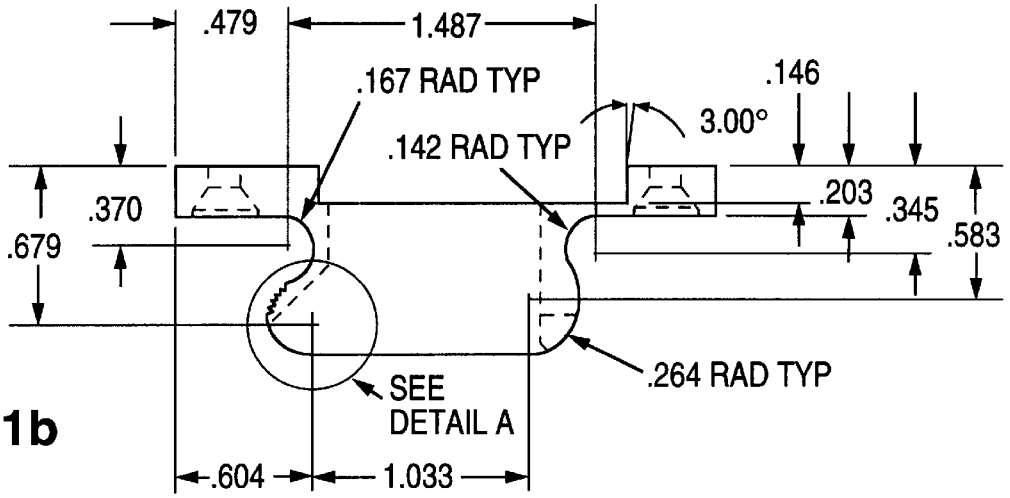
Figure 11C:
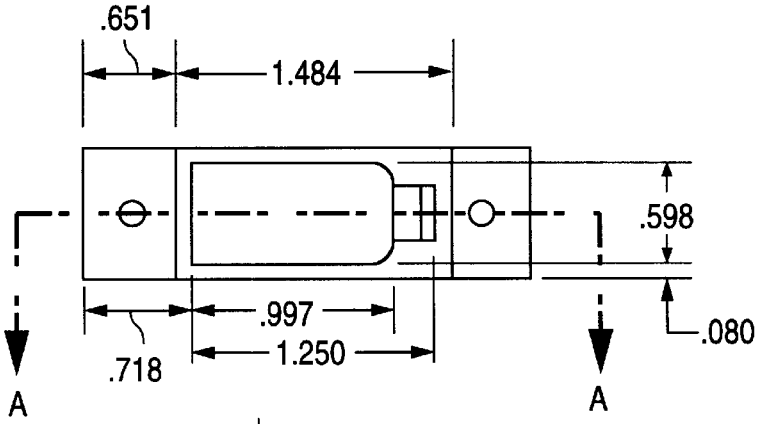
Figure 11D:
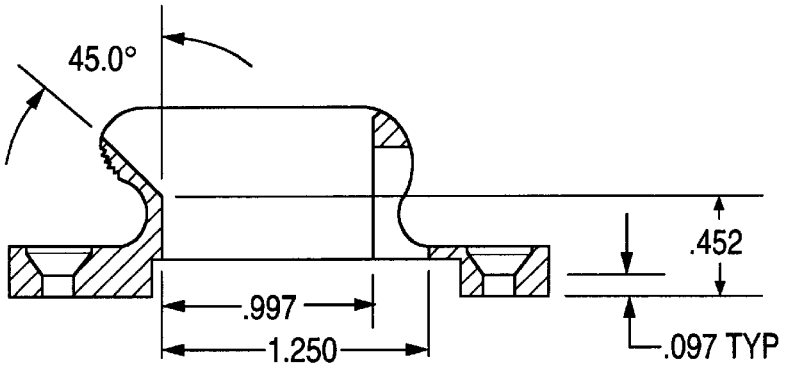
Figure 11E:
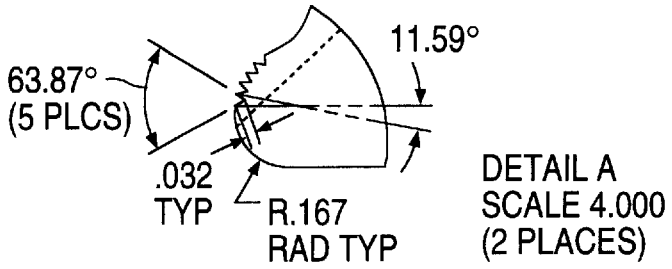
Figure 11F:
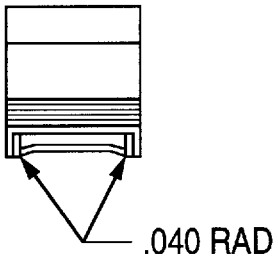
Figure 11G:
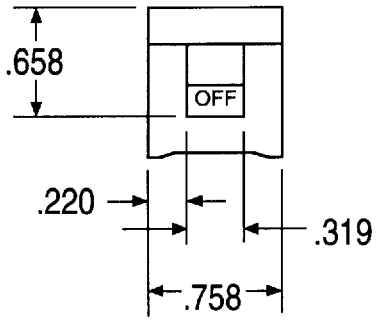
Figure 11H:
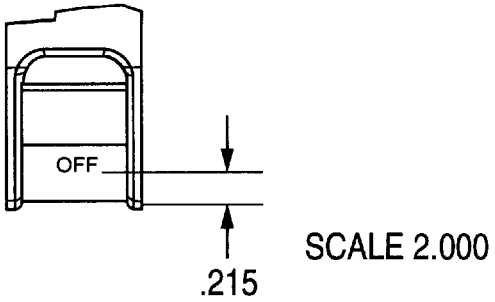

Handle-guard 400 is designed so that the user will automatically trip the actuator-handle 330 of circuit breaker 400 into a non-conducting position every time that the user inserts or removes a circuit breaker by grasping the grip portions 440, 460 of handle-guard 400. FIG. 7 is a cross-sectional view of handle-guard 400 along line 7'—7' of FIG. 6 illustrating the motion of the actuator-handle for the case that the actuator-handle has two operating positions corresponding to an on-position and an off-position. Circuit breaker 350 is shown in phantom, along with actuator-handle 330 in on-position 1 and off-position 2. Arrow 640, shown in phantom, indicates the direction of motion of actuator-handle 330 from on-position 1 to off-position 2. A user's hand 600 is shown in phantom to illustrate how grip surfaces 440, 460 may be grasped by fingers 610, 620, e.g., a thumb and index finger of one hand 600.

As can be seen in FIG. 7, when circuit breaker 350 is to be inserted or removed, one finger 610 of hand 600 grips an exterior surface of second grip portion 440. Second grip portion 440 preferably has an exterior surface shaped and textured to form an ergonomic finger grip surface. A second finger 620 is shown gripping first grip portion 460 (not shown in detail in FIG. 7 because the section is through passageway 470) around passageway 470 and transverse shield surface 480. For the purposes of illustration, actuator-handle 330 is shown as pivoting about pivot point 331, although more generally actuator-handle 330 may move between on-position 1 to off-position 2 by a combination of pivoting and translation.

Handle-guard 400 has slot 430 (not shown in FIG. 7) and passageway 470 dimensioned to accommodate the movement of actuator-handle 330 between on-position 1 and off-position 2. Passageway 470 is also shaped and positioned so that a portion of actuator-handle 330 extends through passageway 470 in on-position 1. As can be seen in FIG. 7, a distal portion 338 of actuator-handle 330 extends in on-position 1 outside of passageway 470. Preferably, distal portion 338 is comparatively small in length so that the handle shield of handle-guard 400, including transverse shield surface 480, protects the distal portion 338 from being inadvertently displaced during normal use. As can be seen in FIG. 7, the act of gripping first grip portion 460 by a finger 620 results in the user applying pressure to distal portion 338 of actuator-handle 330, which will trip actuator-handle 330 to off-position 2. Consequently, the ergonomic design of handle-guard 400 results in the user automatically tripping handle 330 into an off-position 2 whenever the user grasps grip portions 440, 460 to remove or insert circuit breaker 350. Referring to FIG. 6, once circuit breaker is 350 is inserted into place, distal portion 338 of actuator-handle 330 may be moved from its off-position 2 to its on-position 1 by reaching into the opening of slot 430 and pushing actuator-handle 330 using a finger or a tool.

Handle-guard 400 is preferably fabricated from a material that is both an electrical and thermal insulator. A thermally resistive handle-guard 400 assists a user to safely remove a hot circuit breaker. Handle-guard 400 is preferably formed as a molded plastic piece using conventional plastic molding processes.

Figure 8:
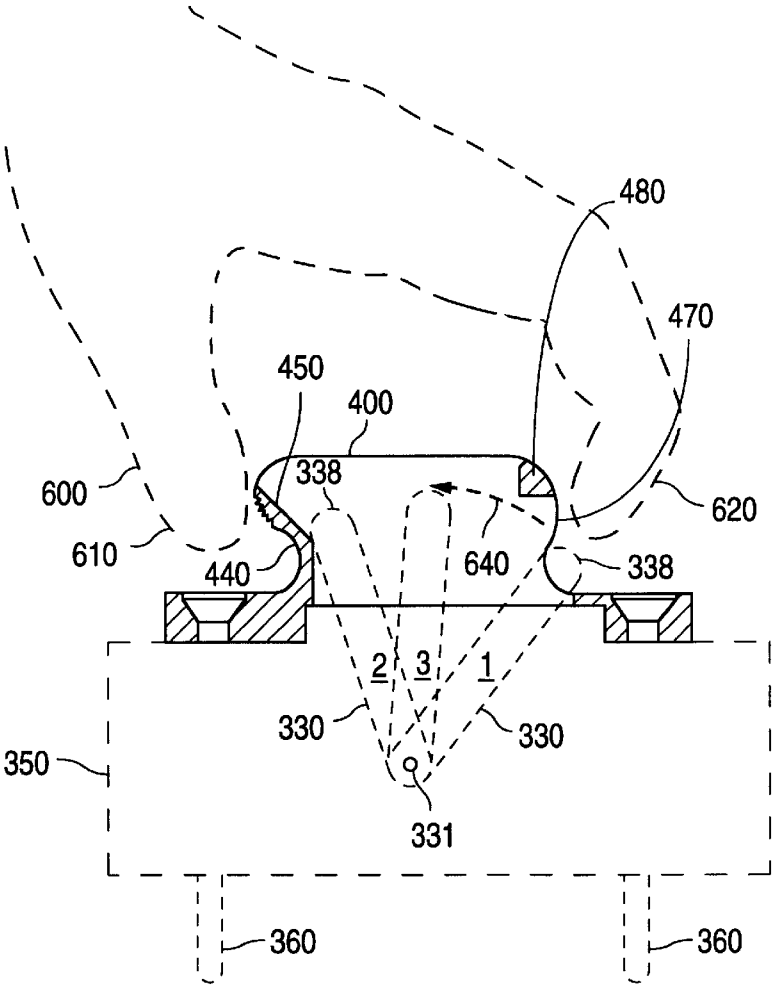
FIG. 8 is a cross-sectional view of the handle-guard of FIG. 7 showing the motion of the actuator-handle between an on-position and a tripped-position.

It will be recognized that while the handle-guard 400 of the present invention has been discussed in regards to a circuit breaker that has an actuator-handle 330 with two positions, the handle-guard of the present invention may also be used with circuit breakers that have an actuator-handle with three positions corresponding to an on-position, tripped position, and off-position. This is shown in FIG. 8, which corresponds to a cross-section along line 7—7 of FIG. 6 for a circuit breaker with an on-position 1, a tripped position 3, and an off-position 2. As can be seen in FIG. 8, arrow 640 indicates that the user will automatically trip the circuit breaker into tripped position 3 by grasping grip surfaces around passageway 470.

Referring again to FIG. 7, it can be seen that the precise dimensions of the surfaces comprising handle-guard 400 will depend upon the shape of actuator-handle 330 and the path which actuator-handle 330 moves when tripped from its on-position to its off-position. As indicated by arrow 640, the shape and position of passageway 470 and shield surface 480 should be selected to permit the free movement of actuator-handle 330 between on-position 2 and off-position 1. Actuator-handle 330 preferably moves substantially within slot 430, i.e., shield surfaces 410, 420 are dimensioned and shaped so that shields 410, 420 protect actuator-handle 330 along its path of movement. Preferably first grip portion 460 and transverse shield surface 480 of handle-guard 400 are shaped to form an overhang so that distal portion 338 of actuator-handle 330 is protected from being inadvertently displaced during normal operation of circuit breaker 350. Additionally, grip portions 440, 460 are preferably ergonomic in the sense of having exterior surfaces shaped and dimensioned so that the user automatically grasps the grip surfaces with different fingers.

Figure 9:
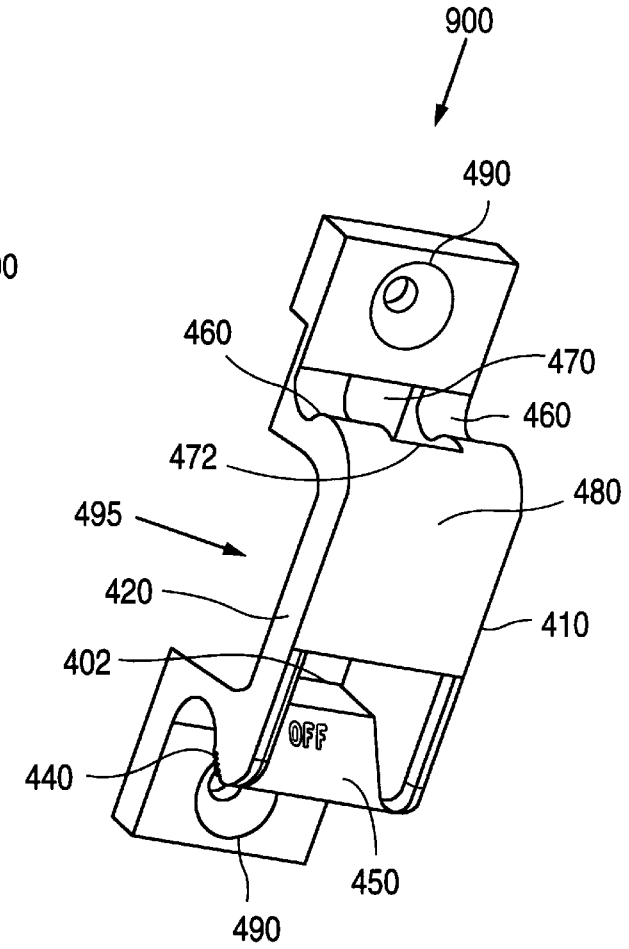
FIG. 9 shows a perspective view of a second embodiment of the handle-guard of the present invention.

It will be recognized that while FIG. 5 shows a preferred embodiment with a slot 430, more generally any shield shaped to surround actuator-handle 330 while permitting free movement of the handle and which has an opening to allow manual displacement of handle 330 is within the scope of the present invention. While a handle-guard 400 with a slot 430 with side shield surfaces 410, 420 and two distal grip portions 440, 460 is a preferred embodiment, more generally any shield shaped to surround an actuator-handle 330 which has an opening to allow manual displacement of the handle may be used. FIG. 9 is a first alternate embodiment of a handle-guard 900 of the present invention. As shown in FIG. 9, transverse shield surface 480 extends substantially over slot 430. Extending transverse shield surface 480 substantially over slot 430 may provide the benefit of greater protection from inadvertent displacement of the actuator-handle 330. Transverse shield surface 480 may also comprise a transparent plastic to permit a head-on view of the position of the actuator-handle 330. As shown in FIG. 9, one of the side-shields 420 of handle-guard 900 has a side opening 495 to permit handle 330 to be manually displaced by the user (e.g., using a screwdriver).

Figure 10:
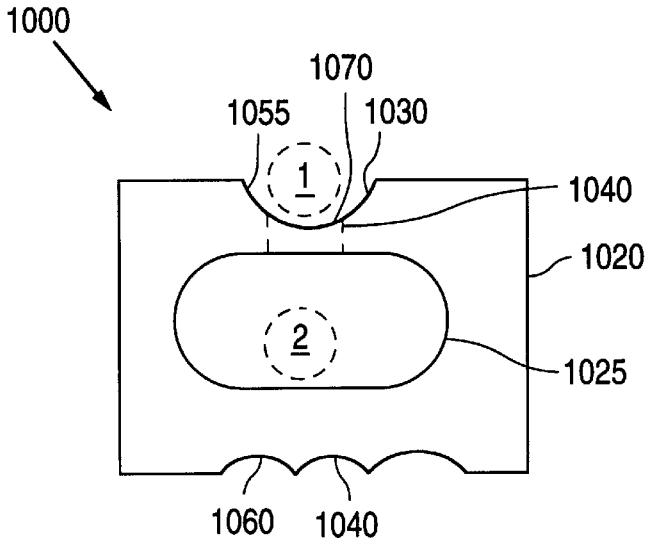
FIG. 10 shows a front view of a third embodiment of the handle-guard of the present invention.

It will be recognized that while FIG. 5 shows a preferred grip configuration, other grip configurations may be used which provide the same function of forcing the user to trip the circuit breaker whenever they grasp grip surfaces adjacent a passageway 470. FIG. 10 is a front-view of a second alternate embodiment 1000 of a handle-guard of the present invention. As shown in FIG. 10, the shield 1020 does not require an inner surface 1025 shaped as a slot with a rectangular cross-section but may form a cavity with any shape consistent with the free motion of actuator-handle 330 between on-position 1 and off-position 2. Grip portions 1030, 1040 are shown as forming part of shield 1020. As shown in FIG. 10, grip portions 1030, 1040 have exterior grip surfaces 1055, 1060 wherein the surface 1055 of one of the grip portions 1030 is adjacent to the exterior opening 1070 of a passageway 1040 (shown in phantom as extending through grip portion 1030) so that the user automatically presses upon a distal portion of actuator-handle 330 when they grasp grip portions 1030, 1040 with two or more fingers of one hand. Grip portions 1030, 1040 may be shaped to form an ergonomic grip with any combination of the fingers of one hand (e.g., thumb and index finger; thumb, index finger and middle finger; or thumb and four fingers).

FIG. 11 shows detailed views of a preferred embodiment of handle-guard 400 for plug-in circuit breakers 350 used in telecommunications applications with preferred dimensions labeled in inches. FIG. 11(*a*) shows a top view of handle-guard 400. FIG. 11(*b*) shows a side view of handle-guard 400. FIG. 11(*c*) shows a bottom view of handle-guard 400. FIG. 11(*d*) shows a cross-section of FIG. 11(*c*) along line A—A. FIG. 11(*e*) shows a side view of a preferred grip surface 440. FIG. 11(*f*) shows a front-view of grip surface 440. FIGS. 11(*g*) and 11(*h*) show views of indicating surface 450.

In summary, the present invention is generally directed to a combined handle-guard and grip for circuit breakers. The present invention provides the benefits of: 1) a shield shaped to protect the actuator-handle from being inadvertently displaced during normal operation; 2) an ergonomic design in which the user automatically trips the circuit breaker to a non-conducting state by grasping the grip portions during insertion or removal of the circuit breaker; 3) providing an indicator surface to permit the user to visually verify that the circuit breaker is tripped; 4) providing an opening in the shield for the user to quickly reset the circuit breaker after it is tripped; and 5) providing a thermally insulating grip to facilitate removal of hot circuit breakers.

Although a preferred embodiment of the present invention and modifications thereof have been described in detail herein, it is to be understood that this invention is not limited to those precise embodiments and modifications, and that other modifications and variations may be affected by one of ordinary skill in the art without departing from the spirit and scope of the invention as defined in the appended claims.

What is claimed is:

1. A combined handle-guard and grip for a circuit breaker having an actuator-handle, comprising:

a shield shaped to surround the actuator-handle to protect the actuator-handle of the circuit breaker from being inadvertently tripped while permitting the free movement of the actuator-handle, said shield having an opening to allow manual displacement of the actuator-handle between an on-position and an off-position;

a first grip portion forming a portion of said shield;

a second grip portion forming another portion of said shield; and a passageway formed in said shield shaped and dimensioned so that a distal portion of the actuator-handle extends through the passageway adjacent the exterior surface of said first grip portion when the actuator-handle is in the on-position.

2. The handle-guard of claim 1, wherein said passageway extends through said first grip portion.

3. The handle-guard of claim 2, wherein said first grip portion is shaped to form an overhang over said passageway to partially shield the distal portion of the handle in the on-position.

4. The handle-guard of claim 1, wherein said shield opening enables direct viewing of the position of said actuator-handle, said handle-guard further comprising: an indicator surface disposed on the interior surface of said second grip portion.

5. The handle-guard of claim 1, wherein said circuit breaker is tripped to a tripped-position when the user grasps the grip portions.

6. The handle-guard of claim 1, where said circuit breaker is tripped to the off-position when the user grasps the grip portions.

7. The handle-guard of claim 1, wherein said shield forms a slot and said first and second grip portions are disposed at opposite ends of said slot.

8. The handle-guard of claim 7, wherein the length and width of said slot and the shape of said first and second grip portions are selected so that the handle-guard may be grasped by the thumb and index finger of one hand.

9. The handle-guard of claim 8, further comprising a mechanical coupler to attach the handle-guard to the surface of the circuit breaker.

10. A safety handle-guard for a circuit breaker, comprising:

a shield shaped to form a slot to protect a handle of the circuit breaker from being inadvertently tripped while permitting the free movement of the handle, said shield having an opening to allow manual displacement of the actuator-handle;

a grip portion disposed at one end of said slot; and a passageway formed in said grip portion linking said slot to the exterior surface of said grip portion, said passageway shaped and dimensioned so that a distal portion of the handle extends through the passageway when the handle is in an on-position.

11. The handle-guard of claim 10, wherein said grip portion is shaped to form an overhang over said passageway to partially shield the distal portion of the handle in the on-position.

12. The handle-guard of claim 11, further comprising: an indicator surface disposed on the interior surface of said second grip portion.

13. The handle-guard of claim 11, wherein said second grip portion has an exterior grip surface.

14. A safety handle-guard for a circuit breaker, comprising:

a first shield;

a second shield spaced apart from said first shield to form a slot with a first end and a second end, said slot shaped and positioned to permit the movement of an actuator-handle of the circuit breaker;

a first grip portion coupled between said first shield and said second shield at said first end, said first grip surface forming a passageway coupling the exterior surface of said first grip portion to said slot; and a second grip portion coupled between said first shield and said second shield at said second end;

wherein a distal portion of the circuit breaker handle extends through said passageway when said actuator-handle is in an on-position so that a user automatically trips said circuit breaker into a non-conducting state when the user grasps the exterior surface of said first grip portion.

15. The handle-guard of claim 14, wherein said first grip portion is shaped to form an overhang over said passageway to partially shield the handle in the on-position.

16. The handle-guard of claim 14, wherein said shield opening enables direct viewing of the position of said actuator-handle, said handle-guard further comprising: an indicator surface disposed proximate the second end of said slot.

17. The handle-guard of claim 16, wherein said indicator surface is disposed on an interior surface of said second grip portion.

18. A handle-guard for a circuit breaker, comprising:

shield means to protect an actuator-handle of the circuit breaker from being inadvertently tripped while permitting the free movement of the actuator-handle;

grip means for grasping the circuit breaker; and passageway means for a distal portion of the actuator-handle to extend proximate to a region where the user grips the handle-guard so that the user automatically trips the handle into an off-position by grasping the circuit breaker.

* * * * *